United States Patent [19]

Chun-cheng

[11] Patent Number: 4,876,795

[45] Date of Patent: Oct. 31, 1989

[54] CUTTER, IN PARTICULAR FOR A SLAT, ESPECIALLY OF A VENETIAN BLIND

[75] Inventor: Huang Chun-cheng, Taipei, Taiwan

[73] Assignee: Teh Yor Industrial Co., Ltd., Taiwan

[21] Appl. No.: 225,269

[22] Filed: Jul. 28, 1988

[51] Int. Cl.[4] ..... B26B 13/10

[52] U.S. Cl. ..... 30/254; 30/229; 30/233; 30/257; 30/261; 30/287; 30/289; 30/296.1

[58] Field of Search ..... 30/254, 244, 233, 251, 30/255, 256, 257, 258, 259, 260, 261, 286, 287, 289, 229, 290, 296 R, 178, 134, 135

[56] References Cited

U.S. PATENT DOCUMENTS

| | | | |
|---|---|---|---|
| 598,031 | 1/1898 | Steen | 30/233 |
| 599,659 | 2/1898 | Moulton | 30/233 |
| 1,528,889 | 3/1925 | Patterson | 30/229 |
| 2,535,383 | 12/1950 | Barnes | 30/229 |
| 2,595,841 | 5/1952 | Glick et al. | 30/229 |
| 4,227,305 | 10/1980 | Newman | 30/233 |
| 4,776,096 | 10/1988 | Chang | 30/229 |

FOREIGN PATENT DOCUMENTS

| | | | |
|---|---|---|---|
| 8989 | 4/1888 | United Kingdom | 30/234 |

*Primary Examiner*—Donald R. Schran
*Assistant Examiner*—Yu Chi Lin

[57] ABSTRACT

A novel cutter, in particular for a slat, especially of a venetian blind is disclosed. This cutter comprises a pair of modified scissors with a respective knife blade partially deflected. A torsional spring is provided for creating a return action on the blades. The cutter further comprises a guide block having an adjustable width and a limit scale having an adjustable length.

8 Claims, 1 Drawing Sheet

CUTTER, IN PARTICULAR FOR A SLAT, ESPECIALLY OF A VENETIAN BLIND

This invention relates to a novel cutter, in particular for a slat, especially of a venetian blind.

At the present time, a venetian blind made of aluminum or polyvinyl chloride slats is widely used. In practice, the slats are manufactured in accordance with a standard dimension at preset width and predetermined length Usually, the length of the slat should be cut to exactly fit the size of a window for use. In the cutting operation, each slat is marked at both ends with a line to be cut, then cut at that line by scissors and trimmed to have the edges rounded. Not only cutting at the marked line of an individual slat is laborious and time consuming, but also the subsequent trimming treatment is tedious and troublesome. Further, personal error makes the cut length of slats unequal and it causes the venetian blind product have a unsightly appearance.

The primary object of the present invention is to provide a cutter, in particular but not limited for a slat, especially of a venetian blind, comprising a pair of modified scissors with a respective knife blade partially deflected and its edge rounded.

Another object of the present invention is to provide a cutter as mentioned above, further comprising a torsional spring spanning over both knife blades to create a return action against the pressure applied thereon.

A further object of the present invention is to provide a cutter as mentioned above, further comprising a guide block having an adjustable width, detachably mounted on a portion of one of the knife blades, for guiding the slat to the knife blades for cutting.

Still a further object of the present invention is to provide a cutter as mentioned above, further comprising a limit scale slidably inserted passing through respective holes provided at suspending holders of the guide block and positioned beneath the knife blades for adjustably limiting a predetermined length of the slat to be cut.

Figure 1:
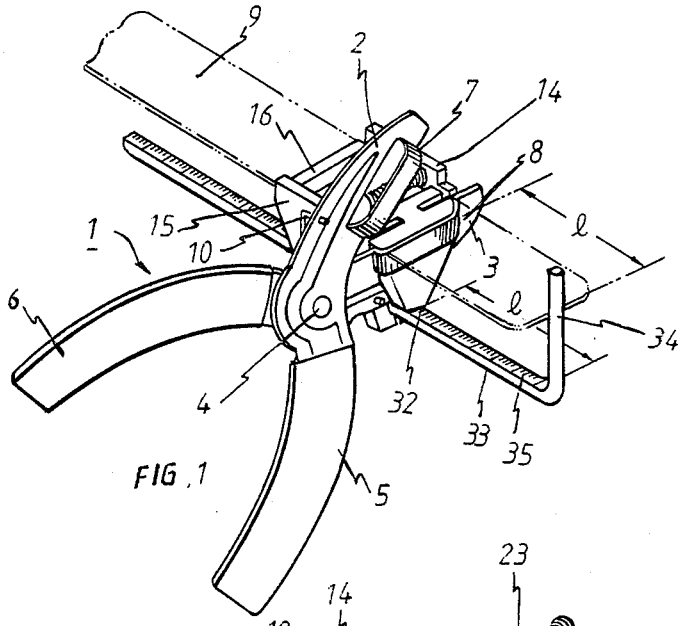
Figure 2:
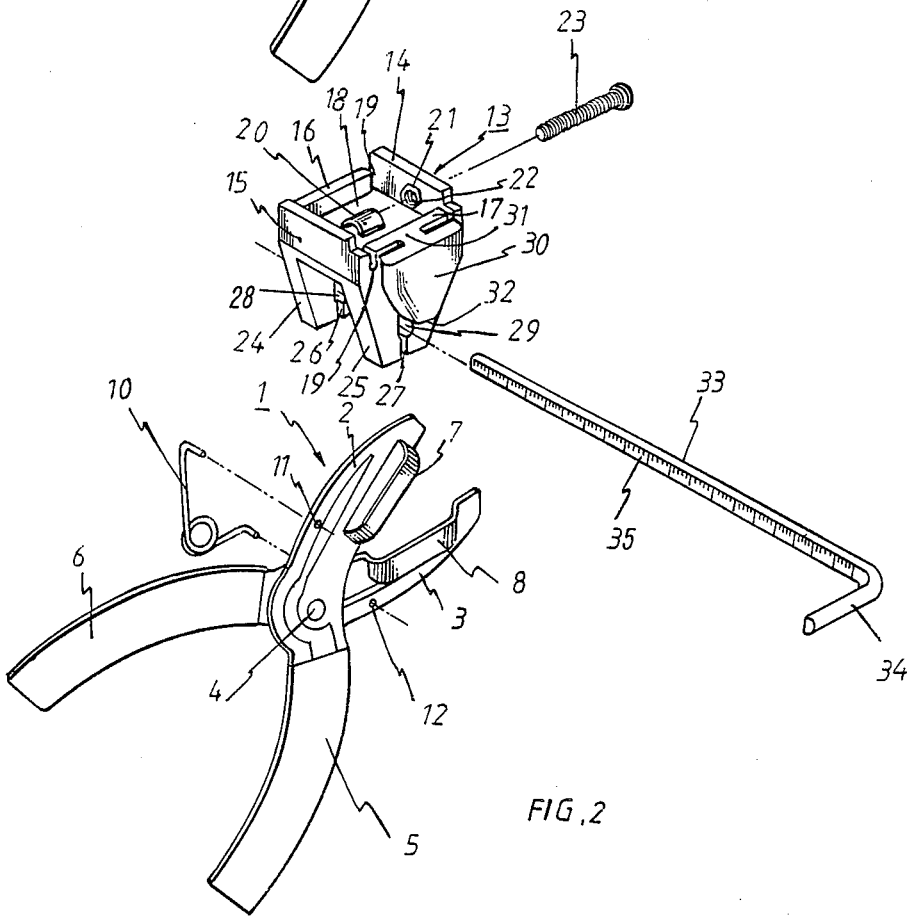

These and other objects, features and advantages will be apparent and better understood from the description set forth below with reference to the accompanying drawings, in which:

FIG. 1 is a perspective view of the present cutter illustrating the operation in cutting a slat of a venetian blind, as partially shown by a two-dotted line; and FIG. 2 is an exploded perspective view of the present cutter.

The drawings as well as the following description are only for the illustrative purpose and by no means intended to limit the scope of the present invention.

Now, reference is made to the drawings. The cutter according to the present invention, as generally designated by 1, comprises a pair of scissors 2, 3 joined together by a pin, bolt or rivet 4 as the fulcrum at substantially the center, and further extends to have a respective handle 5, 6. Each scissor 2 or 3 is modified by being partially offset at a portion of its inner part to form a respective knife blade 7 or 8, for example, by means of pressing, punching and other suitable procedures, in such a manner that a cutting operation may be readily performed by cooperation between said knife blades 7, 8 with each other in ordinary scissors action. The deflected blade 7 or 8 is deviated from and substantially parallel to the plane of respective scissor 2 or 3. Both edges or ends of its each blade 7 or 8 are rounded to form a smooth curvature. The length of this deflected blade 7 or 8 corresponds to the standard width of a slat 9 of a venetian blind to be cut, for example 15 mm, 25 mm and other dimmensions commonly used. So that the present cutter 1 may conveniently cut in particular a slat, especially of a venetian blind, having a corresponding width, to have a neat cut line with rounded cut edges or corners.

In order to create a return action to make the blades 7, 8 part away from each other after both blades 7, 8 come together in each cutting operation, a torsional spring 10 is provided spanning over said blades 7, 8, with each free end inserted into a corresponding hole 11 or 12 formed at the respective scissor 2 or 3 and secured thereat by slightly bending the terminal of said free end that protrudes out of said hole 11 or 12.

The cutter 1 of the present invention further comprises a guide block, as generally designated by 13. This block 13 has a substantially square surface with opposite higher lateral guide walls 14, 15 and opposite lower side walls 16, 17 which all together define a recess 18. A portion of said guide walls 14, 15 near to side wall 17 are cut to have a respective notch. Both ends of said side walls 16, 17 are not engaged with adjacent lateral walls 14 and 15, respectively, but rather are separated to form a respective slit 19 therebetween. On the surface of said recess 18 a length of tunnel 20 is unitary molded therewith and extended transversely at one end terminated and at a slight distance spaced apart from one of said lateral walls, for example 15 as shown, or alternatively 14, while at the other end until approximately half distance between opposite lateral walls 14 and 15. Into another lateral wall 14, as shown, remote from said tunnel 20, or alternatively, lateral wall 15 when said tunnel 20 is alternatively molded close to the wall 14, a bolt nut 21 is embedded in such position that the central thread hole 22 of said nut 21 is aligned with the hollow of said tunnel 20. And an aperture (not shown) corresponding to said central thread hole 22 of said nut 21 is formed in the subject lateral wall 14, or alternatively, lateral wall 15. A bolt 23 is inserted from outside of said lateral wall 14, or alternative wall 15, passing through the aforementioned aperture and hole 22 into said tunnel 20 until the terminal end of said bolt 23 is in contact with the wall 15 as shown or alternatively wall 14 at the opposite side.

For the slat having a standard width of 25.0 mm, for instance, the distance between opposite guide walls 14 and 15 is also 25.0 mm. But the deviation of the width present among various slats from different manufactures will be about 1.0 mm. Namely, in the class of a 25.0 mm slat, the actual width will be from 25.0 mm to 26.0 mm. When the bolt 23 is further threaded in, a force will be applied to both guide walls 14 and 15 through the nut 21 and the terminal end of said bolt 23, respectively, thereby causing said walls 14 and 15 elastically apart wider to suit the slat having a width greater than 25.0 mm to be guided between said walls 14 and 15 to move. The distance between said guide walls 14 and 15 may be adjusted by an amount to 26.0 mm. In another class of slat, for example, having a standard width of 15.0 mm, the distance between opposite walls 14 and 15 is also 15.0mm correspondingly, and may be adjusted in similar manner to about 16.0 mm.

Both side walls 16 and 17 are each suspendingly extended to form a respective holder 24 or 25 in a form of an inverted trapezoid. There is a central slit 26 or 27 in each holder 24 or 25 open to the bottom margin. At an intermediate portion of said slit 26 or 27, a respective enlarged insertion aperture 28 or 29 is formed identical and in alignment with each other. Said aperture 28 or 29 is elliptical in form or D-shape in cross section, or other profile, and has having a longitudinal major axis and a transversal minor axis substantially perpendicular to each other.

A connector 30 is unitary attached outside of one side wall 17 at the central upper portion 31. A spacing preferably in slightly tapered form is formed between the inner surface of said connector 30 and the outer surface of said wall 17 for engaging with one scissor 3, as better shown in Fig.1. Lower end 32 of said connector 30 is preferably extended to a level just above said aperture 29.

A limit scale in L shape is provided with a bend 34 at about right angles at one end. The scale 33 has an elliptical or D shape in cross section or other corresponding profile, so that a flat face 35 or wider axis is formed and indicated or carved with a measure of, preferably, the metric system. Upon assembling, the scale 33 is turned to have said flat face 35 or wider axis along the main axis of said aperture 28, 29 so as to make said scale 33 readily pass through said apertures 28, 29, to the extent that the lower end 32 of said connector 30 just indicates at the measure value representing the length of the slat 9 to be cut. Then the scale 33 is turned to an angle of 90 degrees that makes the flat face 35 or wider axis up, i.e the bend 34 of said scale 33 is thus erected upwardly to serve as a limit stand, as shown in Fig.1. Further, said bend 34 is also in D shaped cross section with the flat face thereof innerwards, as clearly seen from the drawings.

In this state, the wider axis of said scale 33 is along the minor axis of said apertures 28, 29 and therefore said scale 33 is firmly secured by inherent elastic force of the plastic material that the holders 24, 25 and thus the entire guide block 13 are made of. When turned 90° back the scale 33 will be slidably displaced to adjust the position to be set. Then said scale 33 can be further turned to secure at a newly adjusted position.

In use, one may grip the handles 5, 6 of the present cutter with a single hand, and the slat 9 is placed over the guide block 13 at the space between opposite lateral guide walls 14, 15. The distance between both walls 14, 15 is adjusted to suit the width of said slat 9 in the manner as mentioned above. On the other hand, the scale 33 is also adjusted to the position indicating the length l of the slat 9 to be cut. Then the slat 9 is moved to the extreme extent that the leading end of said slat 9 is stopped by the limit bend 34. Then, one only needs to squeeze the scissors handles 5, 6 together. This applies pressure against both sides of the slat 9 which is cut having a length of l when both blades 7, 8 come together. As said pressure is released, the handles 5, 6 as well as the blades 7, 8 are automatically opened, and the slat 9 may be replaced by another for cutting.

The cutter constructed according to the presently preferable embodiment has been described hereinabove as exemplary of the invention. However, it should be apparent that many modifications can be made to the invention without departing from the spirit and scope thereof. Accordingly, the invention is not limited by the foregoing description, but is only limited by the scope of the appended claims.

What I claim is:

1. A cutter, in particular for a slat, especially of a venetian blind, comprising a pair of scissors with extended handles and joined at a center fulcrum, said scissors being partially deflected at a portion of an inner part thereof to form a pair of knife blades deviated from and substantially parallel to the plane of its respective scissor, a guide block having opposite higher lateral guide walls and opposite lower side walls, which all together define a recess, and a connector attached to one of said side walls at a central upper portion thereof to form a spacing between an inner surface of said connector and an outer surface of said one side wall for engaging with one of said scissors.

2. The cutter as set forth in claim 1, further comprising a torsional spring spanning over said blades.

3. The cutter as set forth in claim 1, further comprising a length of tunnel unitarily molded on the surface of said recess and extended transversely at one end and terminated at a slight distance spaced apart from one of said lateral guide walls while at its other end it extends approximately half the distance between the opposite lateral guide walls; a bolt nut embedded in the other guide wall in such a position that a central thread hole of said nut is aligned with the hollow of said tunnel, an aperture corresponding to said central thread hole formed in said other guide wall; and a bolt for insertion from outside of said other guide wall, to pass through said aperture and said hole into said tunnel to the extent that it moves in contact with said one guide wall at a terminal end of said bolt, and wherein both ends of said lower side walls are separated from said lateral guide walls.

4. The cutter as set forth in claim 1 or 3, wherein both said side walls are each suspendingly extended to form a respective holder having a central slit open to a bottom margin.

5. The cutter as set forth in claim 4, wherein a respective enlarged insertion aperture is formed identical and in alignment with each other intermediate of said slit, and wherein said aperture is in a form having a longitudinal major axis and a transversal minor axis.

6. The cutter as set forth in claim 5, further comprising a scale in L form with a bend at about right angles at one end, wherein said scale has a cross section in elliptical or D shape or other profile having a wider axis.

7. The cutter as set forth in claim 6, wherein there is a measure indication on said wider axis.

8. The cutter as set forth in claim 7, wherein a lower end of said connector is extended to a level just above said aperture so as to indicate the measure value on said scale.

* * * * *